US008567631B2

(12) United States Patent
Brunner

(10) Patent No.: US 8,567,631 B2
(45) Date of Patent: Oct. 29, 2013

(54) TOOL BOX

(75) Inventor: Yaron Brunner, Timrat (IL)

(73) Assignee: Keter Plastic Ltd., Herzelyia (IL)

( * ) Notice: Subject to any disclaimer, the term of this patent is extended or adjusted under 35 U.S.C. 154(b) by 820 days.

(21) Appl. No.: 12/526,609

(22) PCT Filed: Feb. 14, 2008

(86) PCT No.: PCT/IL2008/000200

§ 371 (c)(1),
(2), (4) Date: Aug. 28, 2009

(87) PCT Pub. No.: WO2008/099404

PCT Pub. Date: Aug. 21, 2008

(65) Prior Publication Data

US 2010/0012538 A1 Jan. 21, 2010

Related U.S. Application Data

(60) Provisional application No. 60/901,331, filed on Feb. 15, 2007, provisional application No. 60/924,267, filed on May 7, 2007.

(51) Int. Cl.
*B65D 45/22* (2006.01)
*B65D 43/22* (2006.01)

(52) U.S. Cl.
USPC ..... 220/326; 220/835

(58) Field of Classification Search
USPC ..... 220/326, 4.22, 833, 835; 206/1.5
See application file for complete search history.

(56) References Cited

U.S. PATENT DOCUMENTS

| | | | | | |
|---|---|---|---|---|---|
| 2,912,271 | A | * | 11/1959 | Schaefer | 292/336.3 |
| 4,875,721 | A | * | 10/1989 | Okamoto et al. | 292/29 |
| D306,096 | S | | 2/1990 | Dickinson et al. | |
| 5,042,853 | A | * | 8/1991 | Gleason et al. | 292/126 |
| 5,235,830 | A | | 8/1993 | Benge | |
| 5,472,351 | A | * | 12/1995 | Greco et al. | 439/353 |
| 5,580,182 | A | * | 12/1996 | Lin | 403/325 |
| 5,595,076 | A | | 1/1997 | Weinerman et al. | |

(Continued)

FOREIGN PATENT DOCUMENTS

| | | |
|---|---|---|
| EP | 1 199 002 A1 | 4/2002 |
| EP | 1 520 660 A2 | 4/2005 |

*Primary Examiner* — Mickey Yu
*Assistant Examiner* — Niki Eloshway
(74) *Attorney, Agent, or Firm* — Vorys, Sater, Seymour and Pease LLP; Susanne M. Hopkins; William L. Klima

(57) ABSTRACT

A toolbox including a basin portion and a lid pivotally articulated thereto between an open position and a closed position, is provided. The lid includes two or more latches, each positionable between a locked position and an unlocked position, two or more biasing members, each associated with one of the latches and adapted to bias its associated latch toward its locked position, and an activation mechanism operationally connected to the latches such that operation of the activation mechanism brings all of the latches to their unlocked positions. The basin includes two or more latch-receiving arrangements, each configured to receive one of the latches when in the locked position with the lid in its closed position, thereby preventing articulation of the lid to its open position. The latches and latch-receiving arrangements are mutually configured such that upon articulation of the lid toward its closed position, the latch-receiving arrangements are configured to urge the latches from their locked positions so as to allow the lid to be brought fully to its closed position.

16 Claims, 14 Drawing Sheets

(56) References Cited

U.S. PATENT DOCUMENTS

| | | | | |
|---|---|---|---|---|
| 5,601,206 | A | 2/1997 | Haas et al. | |
| D394,955 | S | 6/1998 | Dickinson et al. | |
| D416,682 | S | 11/1999 | Tanji | |
| D417,956 | S | 12/1999 | Story et al. | |
| D418,294 | S | 1/2000 | Tanji | |
| D424,297 | S | 5/2000 | Story et al. | |
| D434,225 | S | 11/2000 | Story et al. | |
| 6,220,478 | B1 * | 4/2001 | Ingerson et al. | 220/831 |
| D453,624 | S | 2/2002 | Itzkovitch | |
| D462,168 | S | 9/2002 | Klemmensen et al. | |
| 6,502,868 | B1 | 1/2003 | Laspa et al. | |
| D470,659 | S | 2/2003 | Story et al. | |
| 6,540,268 | B2 | 4/2003 | Pauser | |
| D493,034 | S | 7/2004 | Bar-Erez | |
| D505,011 | S | 5/2005 | Einav | |
| D525,789 | S | 8/2006 | Hosking | |
| 7,164,578 | B2 * | 1/2007 | Wang et al. | 361/679.08 |
| 7,370,772 | B2 * | 5/2008 | Brunson | 220/326 |
| 7,436,656 | B2 * | 10/2008 | Jiang et al. | 361/679.55 |
| 7,810,862 | B2 * | 10/2010 | Smith | 296/24.34 |
| 2002/0108410 | A1 * | 8/2002 | Webb et al. | 70/159 |
| 2002/0117414 | A1 * | 8/2002 | Kipper et al. | 206/373 |
| 2003/0168466 | A1 * | 9/2003 | Spiers et al. | 220/835 |
| 2007/0084865 | A1 * | 4/2007 | Moore | 220/326 |
| 2007/0158223 | A1 | 7/2007 | Terry | |
| 2008/0110893 | A1 * | 5/2008 | Cowie et al. | 220/324 |

* cited by examiner

TOOL BOX

This is a National Phase Application filed under 35 U.S.C. 371 as a national stage of PCT/IL2008/000200, filed on February 14, 2008, an application claiming the benefit under 35 U.S.C. 119(e) U.S. Provisional Application No. 60/901,331, filed on February 15, 2007 and claiming the benefit under 35 U.S.C. 119(e) U.S. Provisional Application No. 60/924,267, filed on May 7, 2007, the entire content of each of which is hereby incorporated by reference in its entirety.

FIELD OF THE INVENTION

This invention relates to toolboxes and more particularly to those having reinforced sides and/or to those having a lid hingedly articulated to a base.

BACKGROUND OF THE INVENTION

Toolboxes and the other similar containers are commonly used in a variety of fields, such as construction, repairs, etc., to store and to transport tools to and from a jobsite or between locations at a jobsite.

Such containers are typically made from plastic or metal, and may be reinforced. In addition, they may comprise a base portion having a cavity to store therewithin tools, and a lid pivotally articulated thereto. Locking means are often provided so that the contents do not spill during transport.

U.S. Pat. No. 6,502,868 discloses a Dual T-Lock connecting two T-handle latch assemblies such that one latch assembly can be released, automatically releasing, through the transverse lock rod, the other latch assembly. A Dual T-Lock comprises two T-handle latch assemblies provided with the Dual T-Lock Apparatus. A toolbox is provided that fitted with a Dual T-Lock and suitable for use in a truck. A toolbox is provided that is fitted with T-handle latch assemblies fitted with a Dual T-Lock Apparatus.

SUMMARY OF THE INVENTION

According to one aspect of the present invention, there is provided a toolbox comprising a basin portion and a lid pivotally articulated thereto between an open position and a closed position, the lid comprising:

- two or more latches, each positionable between a locked position and an unlocked position;
- two or more biasing members, each associated with one of the latches and adapted to bias its associated latch toward its locked position; and
- an activation mechanism operationally connected to the latches such that operation of the activation mechanism brings all of the latches to their unlocked positions;

the basin comprising two or more latch-receiving arrangements, each adapted to receive a first end of one of the latches when in the locked position with the lid in its closed position, thereby preventing articulation of the lid to its open position; he latches and latch-receiving arrangements being mutually configured such that upon articulation of the lid toward its closed position, the latch-receiving arrangements are adapted to urge the latches from their locked positions so as to allow the lid to be brought fully to its closed position.

The toolbox may be formed so that upon full articulation of the lid into its closed position, each biasing members spontaneously returns its associated latch to its locked position.

Each biasing member may be constituted by a sheet spring, and/or formed integrally with its associated latch.

The biasing members may constitute parts of the lid, each being disposed adjacent to its associated latch. The biasing members may formed integrally with the lid, or be formed as separate member attached to the lid.

Each of the latches may be adapted to pivot between its unlocked and locked positions.

Each of the latch-receiving arrangements may comprise a latch-receiving notch and a barrier therein, with each of the latches comprising a lip at the first end thereof, the lip being adapted to bear against the barrier when the lid is in its closed position and the latch is in its locked position.

The activation mechanism may be operationally connected to the latches by a rod. Upon operation of the activation mechanism, the rod may bear upon a second end, being opposite the first end, of each latch, thereby pivoting each latch into its unlocked position. The rod may be received within the second end of each latch.

The activation mechanism may comprise a lever pivotally articulated to the lid, the lever being rigidly attached to a guide member extending therefrom, the guide member being positioned so as to bear upon the rod when the activation member is operated.

The activation mechanism may be operationally connected to each latch by a connecting member associated therewith (i.e., associated with each latch). Each of the latch-receiving arrangements may comprise a protrusion, with each of the latches comprising a lip at a first end thereof (i.e., of the latch), the lip being adapted to bear against the protrusion when the lid is in its closed position and the latch is in its locked position. Upon operation of the activation mechanism, the connection member may pull a second end, being opposite the first end, of each latch, thereby pivoting each latch into its unlocked position. Each of the connection members may be pivotally articulated to the second end of its associated latch.

A bottom surface of each of the latches may be angled with respect to the direction of movement of the lid.

The activation mechanism may further comprise transmission members, each transmission member being:

- slideably received within the lid so that is can slide along an axis, which may extend substantially between two latches; and
- associated with a latch so that actuation thereof along the axis brings its associated latch into its unlocked position.

The activation member may further comprise a push-member formed so that upon actuation thereof in a direction substantially perpendicular to the axis, the transmission members are actuated along the axis. The push-member and transmission members may be formed with inclined portions, with each of the transmission member being formed with a freely rotating roller, the inclined portions and rollers being co-disposed such that the actuation of the push-member effects the actuation of the transmission members along the axis. A push-member biasing member, adapted to return the push-member to its initial state after the actuation thereof, may be further provided.

The toolbox may be made of plastic.

The toolbox may further comprise one or more cushioning members, positioned (i.e., located) so as to provide cushioning between the lid and the basin portion when the lid is brought from its open position to its closed position.

The cushioning member may be attached to the lid or formed integrally therewith, on a portion thereof which is adapted to be adjacent the basin portion when the lid is in its closed position.

The cushioning member may be attached to the basin portion or formed integrally therewith, on a portion thereof which is adapted to be adjacent the lid when the lid is in its closed position.

The latches and the cushioning members may be located on the same side of the toolbox.

An advantage of a latch locking mechanism according to embodiments of this aspect is that a user may easily unlock all latches simultaneously, using only one activating mechanism (so that only one hand is required by the operator). Furthermore, the mechanism enables a drop-lock type toolbox, such that when the lid is dropped into its closed position all latches simultaneously and spontaneously lock under weight of the lid or due to the motion associated with its closing.

According to another aspect of the present invention, there is provided a toolbox comprising a basin portion, the basin portion comprising a substantially vertically extending sidewall and a bottom wall constituting a basin cavity, the sidewall comprising at least one substantially vertically extending hollow tubular member formed integrally therewith.

The sidewall may constitute a vertically extending substantially rectangular shape comprising four faces joined at edges.

The hollow tubular member or members may be formed in at least one of the edges or in at least one of the faces.

The sidewall and the bottom may be integrally formed.

The toolbox may further comprise a lid pivotally articulated to the basin portion.

The toolbox may be made of plastic.

The toolbox may be adapted to receive therein an upper tray, which may comprise sidewalls and a bottom, the sidewall comprising at least one vertically extending hollow tubular member formed integrally therewith.

The hollow tubular members may be open at one end (i.e., open at one end and closed at the other) or both ends, or closed at both ends.

Herein the specification and claims, prepositions are to be understood in their broadest sense, including, but not limited to, a description of an element extending beyond the object of the proposition. (Thus, e.g., an element described being above or below a member, or between two members, may partially extend beyond one or more of the members.)

BRIEF DESCRIPTION OF THE DRAWINGS

In order to understand the invention and to see how it may be carried out in practice embodiments will now be described, by way of non-limiting examples only, with reference to the accompanying drawings, in which.

DETAILED DESCRIPTION OF EMBODIMENTS

Figure 1:
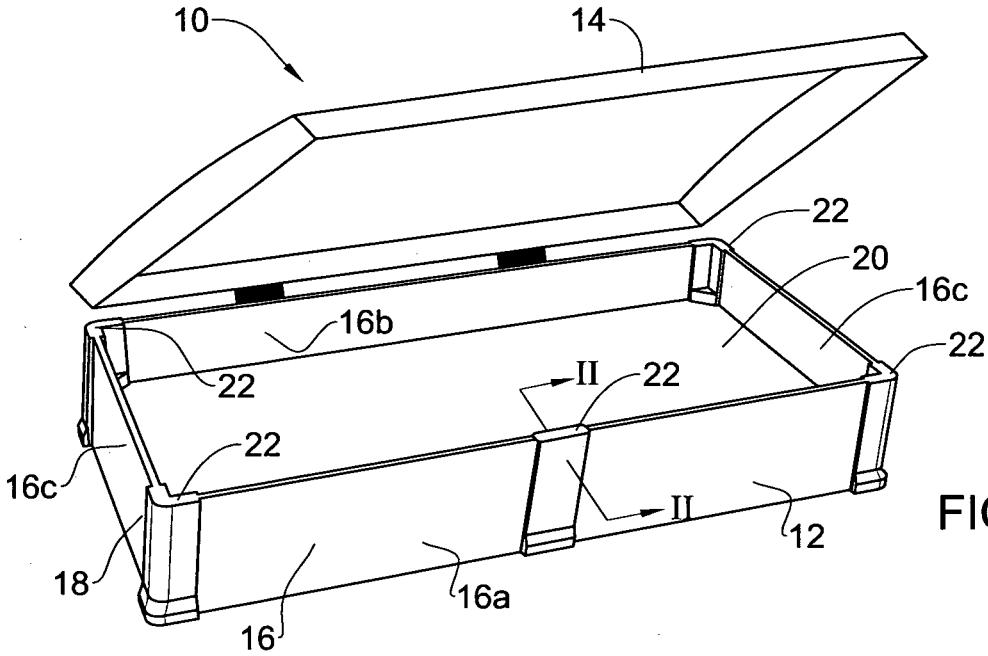
FIG. 1 is a perspective view of a toolbox according to one embodiment of the present invention.

According to one embodiment, as illustrated in FIG. 1, there is provided a toolbox, generally indicated at 10, in accordance with one example thereof. The toolbox 10 comprises a basin portion 12 and a lid 14 pivotally articulated thereto. The basin portion 12 comprises a vertically extending sidewall 16 and a bottom wall 18 which together define a basin cavity 20. The sidewalls comprise front and back faces 16*a*, 16*b*, and side faces 16*c*. The sidewall 16 comprises vertically extending hollow tubular members 22 formed integrally therewith.

The tubular members provide strength to the basin portion 12 of the toolbox 10, enabling it to withstand high compressional loads, such as a person standing thereon, or stacking of several toolboxes filled with tools, etc. In addition, when transporting the toolbox 10 when full, buckling and/or twisting of the basin portion 12 are prevented.

Figure 2A:
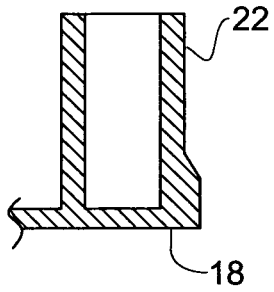
FIGS. 2A through 2C are partial cross-sectional views according to modifications of the present invention taken along line II-II in FIG. 1.
Figure 2B:
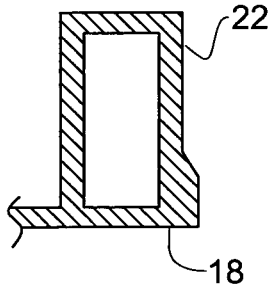
Figure 2C:
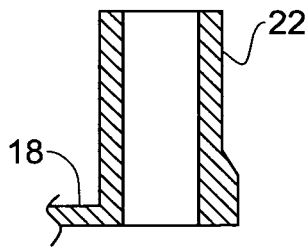

As illustrated in FIGS. 2A, 2B, and 2C, respectively, the tubular members 22 as illustrated in FIG. 1 may be open at one end and closed at the other end by the bottom wall 18, closed at both ends, or open at both ends.

It will be appreciated that although the tubular members 22 in FIG. 1 are illustrated as being at edges of the sidewall 16 and in the middle of the front face 16*a*, any arrangement of tubular members is possible without departing from the spirit and scope of the present invention.

Figure 3:
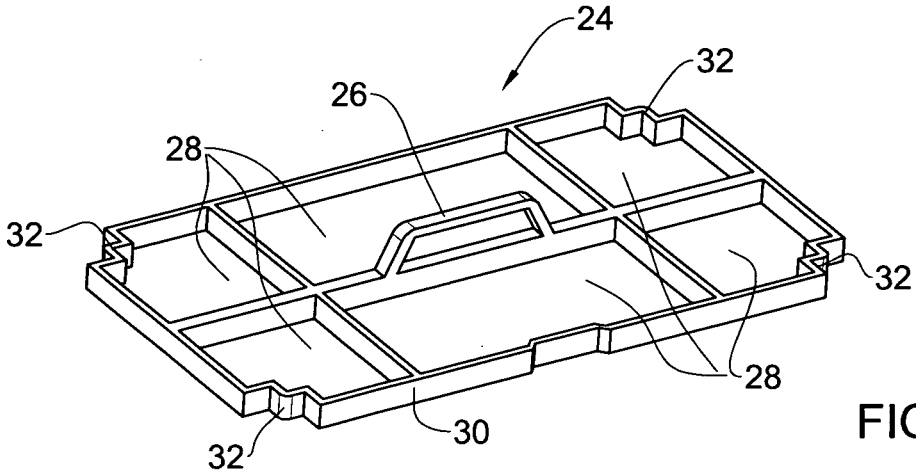
FIG. 3 is a tray according to the present invention for use with the toolbox illustrated in FIG. 1.

In addition, as illustrated in FIG. 3, the toolbox 10 may further be provided with an inner tray 24, formed so as to conform to the shape of the basin cavity 20. The inner tray 24 is removable, and is adapted to sit inside the sidewall 16 such that it does not substantially project above the top thereof when fully received within the basin cavity 20. A carrying handle 26 is provided for easy removal from the toolbox 10 and for convenient carrying. The inner tray 24 may be subdivided into compartments 28 for holding small hardware, screws, fasteners, etc. Sidewalls 30 of the inner tray may also be formed with vertically extending hollow tubular members 32 formed integrally therewith, which may be open at one or both ends, or closed at both ends.

Figure 4:
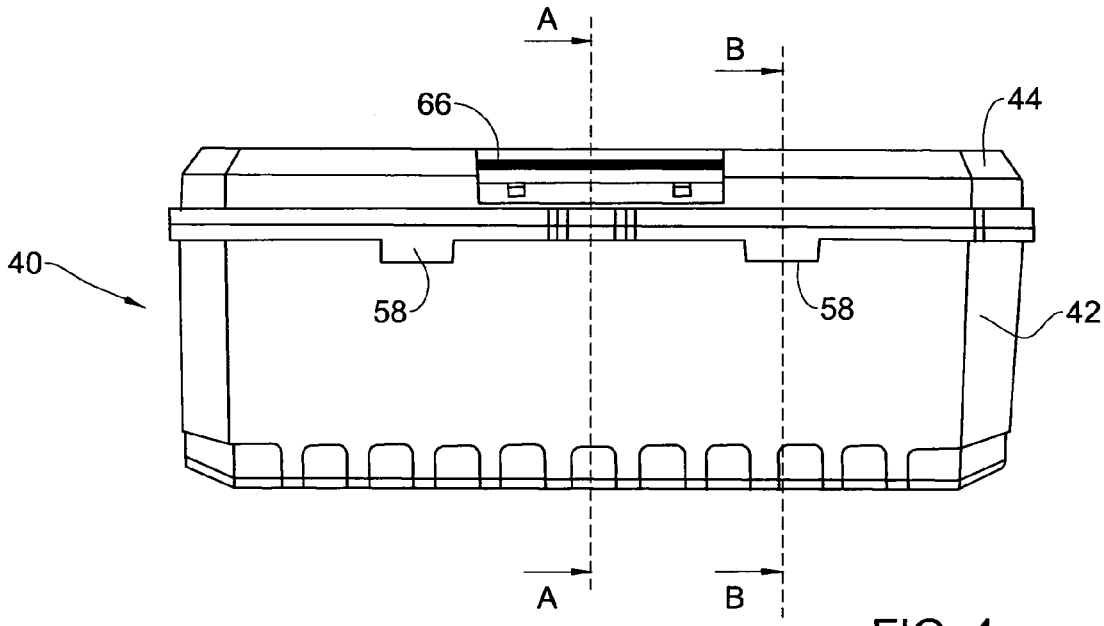
FIG. 4 illustrates a toolbox according to another embodiment of the present invention in a locked position.
Figure 4A:
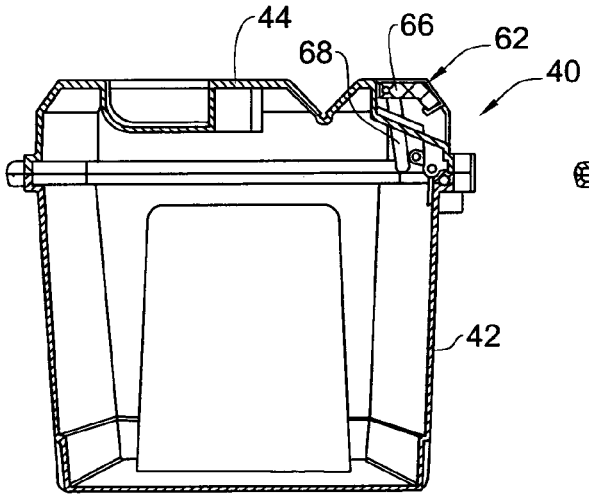
FIGS. 4A and 4B are cross-sectional views taken along lines A-A and B-B, respectively, in FIG. 4.
Figure 5:
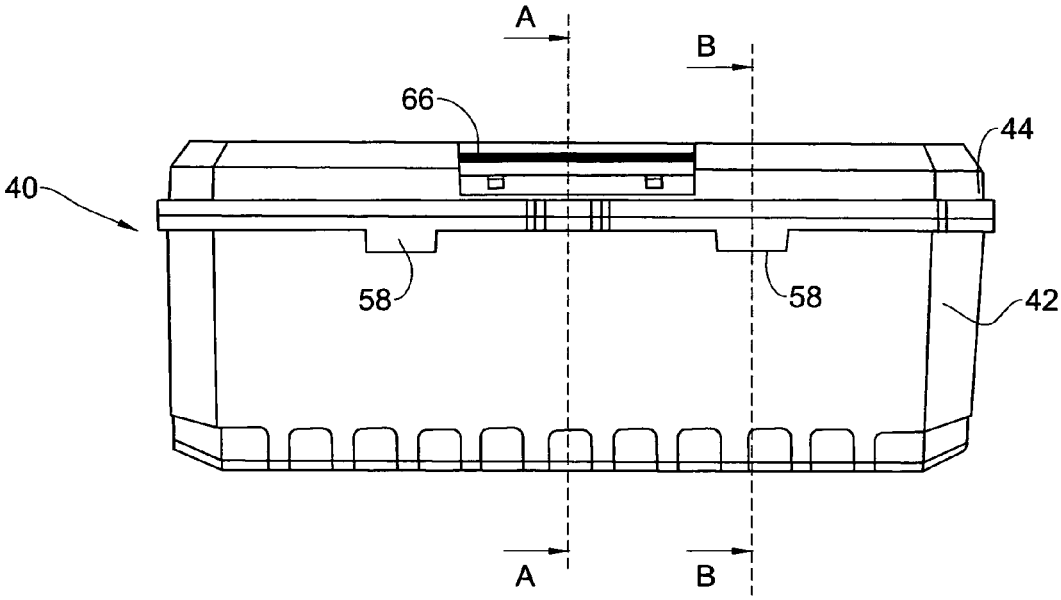
FIG. 5 illustrates the toolbox illustrated in FIG. 4 in an unlocked position.
Figure 5A:
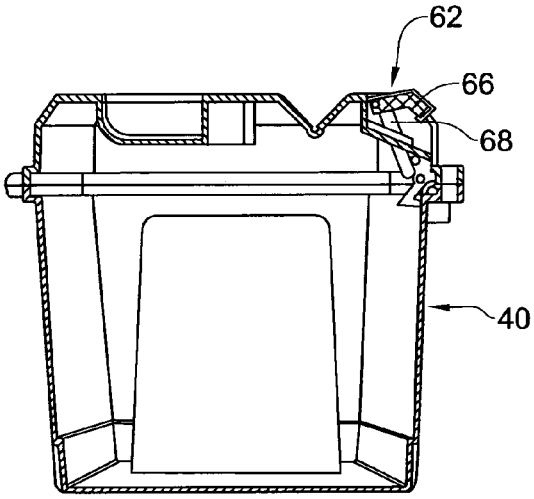
FIGS. 5A and 5B are cross-sectional views taken along lines A-A and B-B, respectively, in FIG. 5.
Figure 5B:
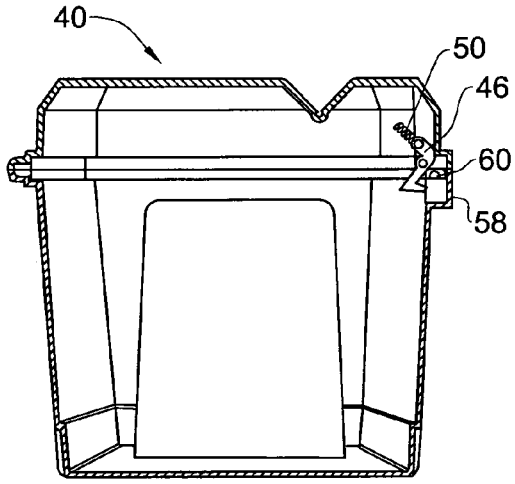

According to another embodiment, as illustrated in FIGS. 4 through 5B, there is provided a toolbox, generally indicated at 40, which comprises a basin portion 42 and a lid 44 pivotally articulated thereto between an open position.

Figure 4B:
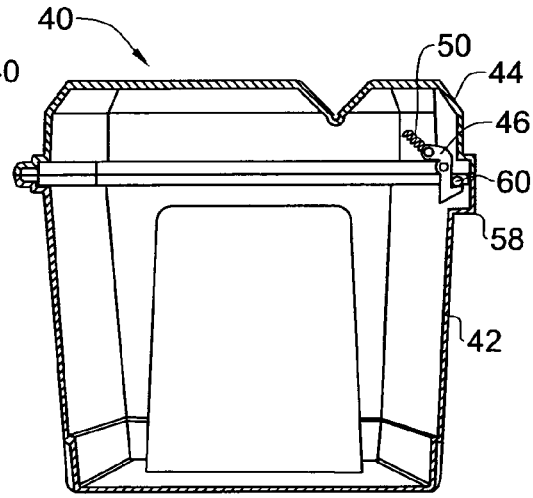
Figure 6:
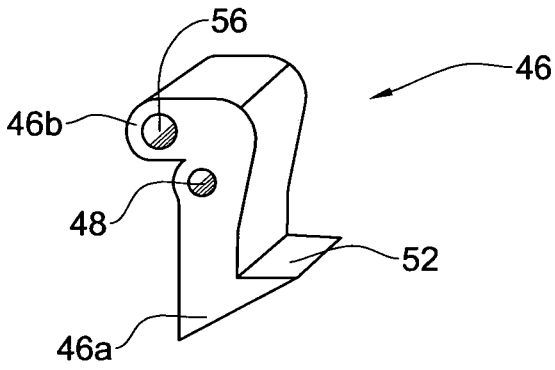
FIG. 6 illustrates a latch of the toolbox illustrated in FIGS. 4 and 5.

The lid 44 comprises two latches 46, shown in more detail in FIG. 6, each pivotally articulated about a central point 48 thereto, such that it may pivot between a locked position, such as illustrated in FIG. 4B, and an unlocked position, such as illustrated in FIG. 5B. Biasing members 50, such as springs, one associated with each latch 46, are provided, each to bias or urge its respective latch to the locked position. Each latch 46 comprises a lower end 46*a* having an upwardly facing lip 52 and an angled lower surface 54, and an upper end 46*b* having a through-going aperture 56.

The basin portion 42 comprises two latch receiving notches 58, constituting latch-receiving arrangements, each being formed, e.g., as a cavity within a sidewall of the basin portion 42 of the toolbox, and each adapted to receive therein one of the latches 46 when the lid 44 is in its closed position and the latch is in its locked position, thus preventing opening of the lid without pivoting the latches to their unlocked positions. To that end, a barrier 60, such as a rod, may be provided within each notch 58. The barrier is positioned such that when the lid 44 is in its closed position and the latch 46 is in its locked position, the lip 52 bears against the barrier when an attempt to open the lid is made.

Figure 7:
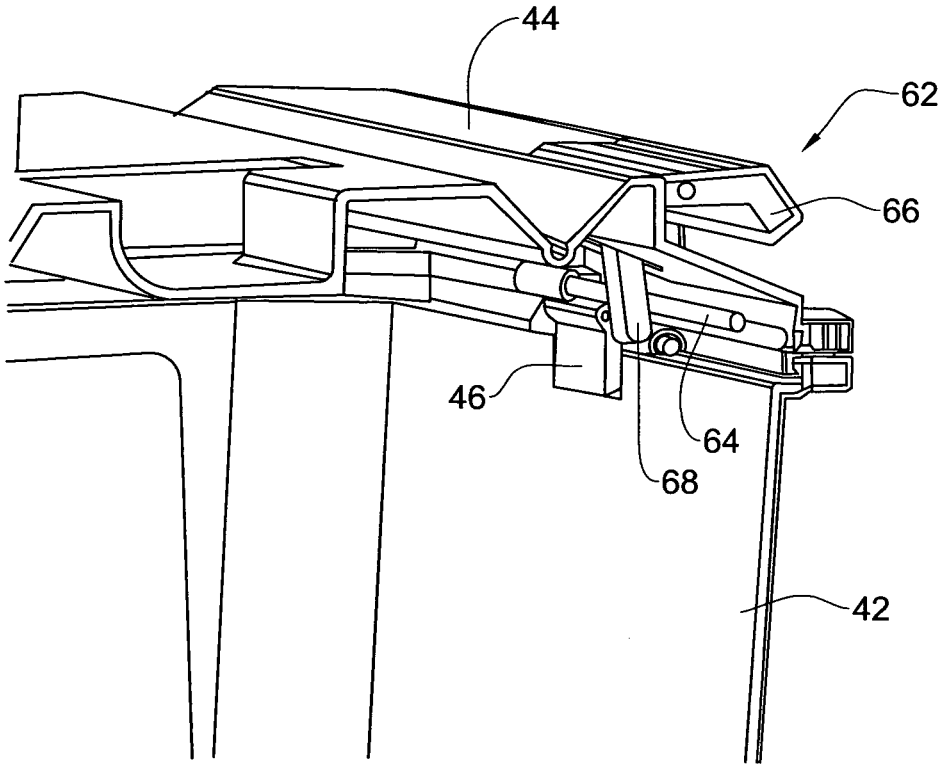
FIG. 7 is a rear cutaway view of the toolbox as illustrated in FIG. 4.

In addition, and as further seen in FIG. 7, the lid 44 comprises an activation mechanism, generally indicated at 62, which is located between the latches 46 and operationally connected thereto via a rod 64. The activation mechanism 62 comprises a lever 66 which is pivotally connected to the top of the lid 44 and projecting from an exterior side 44*a* of the lid, and a guide member 68 rigidly attached thereto, extending through the lid and projecting from an interior side 44*b* of the lid. Ends of the rod 64 are received within the through-going apertures 56 formed within the latches 46. The activation mechanism 62 is operated by pivoting the lever 66 upwardly, which brings the guide member 68 toward the front of the toolbox 40. This pivots the latches 46 into their unlocked positions, allowing the lid 44 to be opened. Thus, a single upward motion, which may be performed with one hand, is sufficient to unlock and open the lid 44.

While the activation mechanism 62 is described herein as being in the form of a lever, it will be appreciated that the scope of the invention is not thus limited, and the activation mechanism may be embodied by a button, a handle, etc.

When the lid 44 is pivoted from the open position into the closed position, the lower surface 54 of each of the latches 46, which, due to the biasing members 50, are in their locked positions, strike the barrier 60. Due to the angle of the lower surfaces 54, the latches 46 are pivoted temporarily into their respective unlocked positions, thereby allowing the lid to fully close. Once the lower surfaces 54 completely pass the barriers 60, the biasing members 50 return the latches 46 to their locked positions. Thus, the toolbox 40 may be "drop-locked", i.e., the lid 44 may be closed, and the latches 46 automatically lock the toolbox.

Figure 8A:
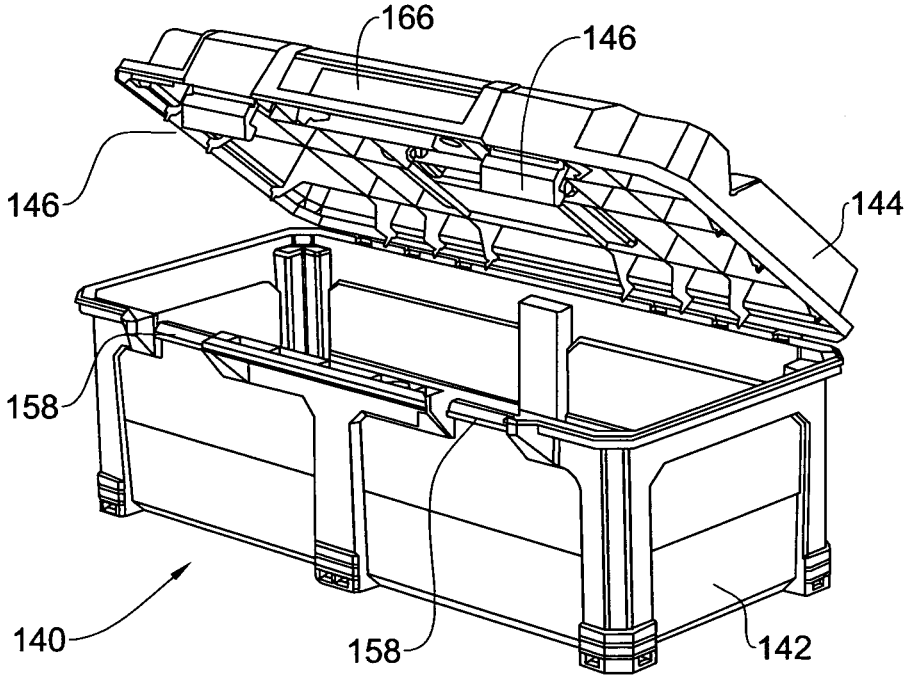
FIGS. 8A and 8B are perspective views of a toolbox according to another embodiment with the lid in an open and closed position, respectively.
Figure 8B:
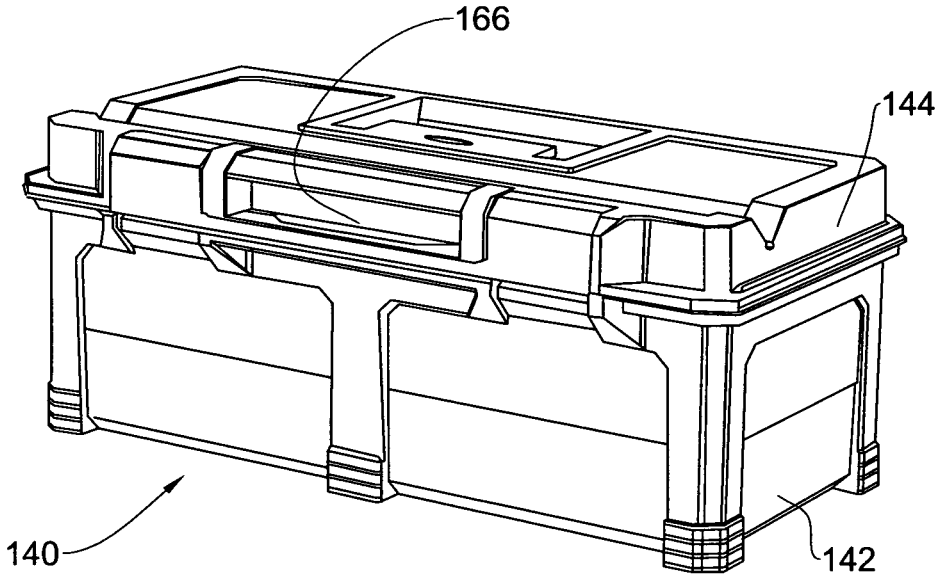

According to another embodiment, as illustrated in FIGS. 8A through 11D, there is provided a toolbox, generally indicated at 140, which comprises a basin portion 142 and a lid 144 pivotally articulated thereto between an open position, for example as seen in FIG. 8A, and a closed position, for example as seen in FIG. 8B.

As better seen in FIG. 8A, the lid 144 comprises two latches 146 and a lever 166, which is pivotally connected to the top of the lid and constitutes part of an activation mechanism, the rest of which is not visible in FIG. 8A.

Figure 9A:
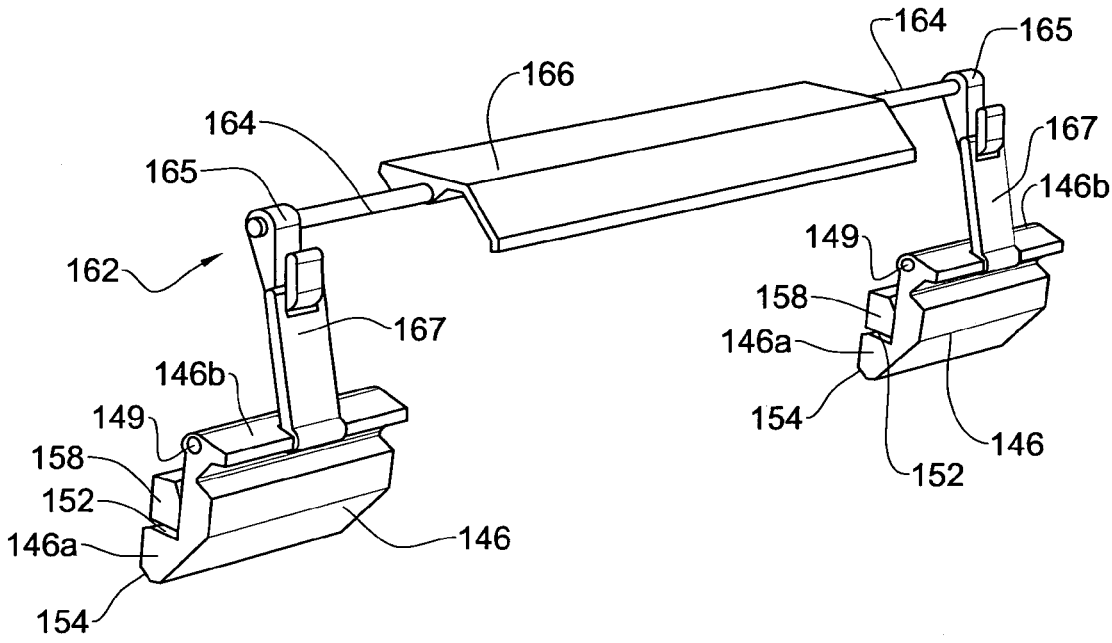
FIG. 9A is a perspective view of an activation mechanism and latches of the toolbox illustrated in FIGS. 8A and 8B.

FIG. 9A better illustrates the activation mechanism 162 and the latches 146.

Each latch 146 is adapted to pivot between a locked position (as illustrated, e.g., in FIG. 10A) and an unlocked position (as illustrated, e.g., in FIG. 10B) about a pin 149 which is connected to the inside of the lid 144 (not illustrated in FIG. 9A). Biasing members (not illustrated in FIG. 9A) may be provided, each to bias or urge its respective latch to the locked position. Each latch 146 comprises a lower end 146*a* having an upwardly facing lip 152 and an angled lower surface 154, and an upper end 146*b*.

The activation mechanism 162 comprises the lever 166, lifting members 165, and a transmission rod 164 therebetween. It will be appreciated that the transmission rod 164 may be formed as a single piece, or may be formed as two separate pieces, one on each side of the handle 166. A connecting member 167 is operationally disposed between each lifting member 165 and one of the latches 146. The connecting member is pivotally accommodated within a portion of the upper end 146*b* of its corresponding latch 146.

The basin portion 142 comprises two protrusions 158, constituting latch-receiving arrangements. Each of the protrusions may be formed integrally with a sidewall of the basin portion 142 of the toolbox, or as a separate piece attached thereto. Each protrusion 158 is adapted to prevent one of the latches 146 from being raised when the lid 144 is in its closed position and the latch is in its locked position, thus preventing opening of the lid without pivoting the latches to their unlocked positions. This is accomplished by the co-disposition of the each protrusion 158 and its respective latch 146, when in its locked position with the lid 144 in its closed position, such that the upwardly facing lip 152 bears against the bottom surface of the protrusion 158 when an attempt to open the lid is made.

Figure 10A:
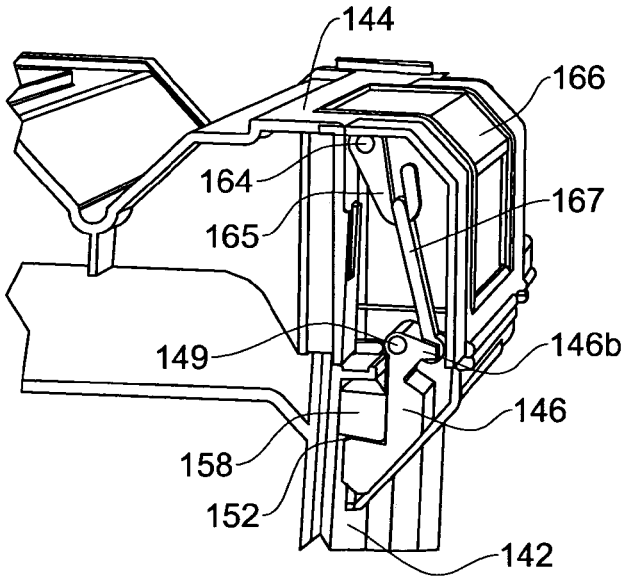
FIGS. 10A through 10C are cross-sectional views, taken along line VII-VII in FIG. 8B, of the toolbox during opening thereof.
Figure 10B:
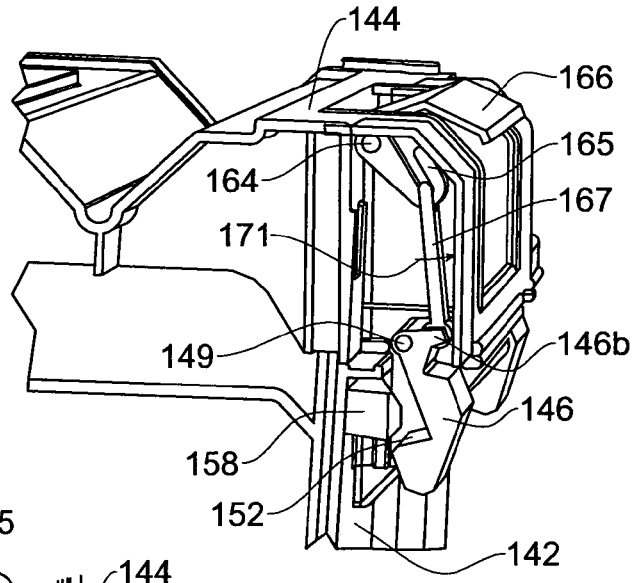
Figure 10C:
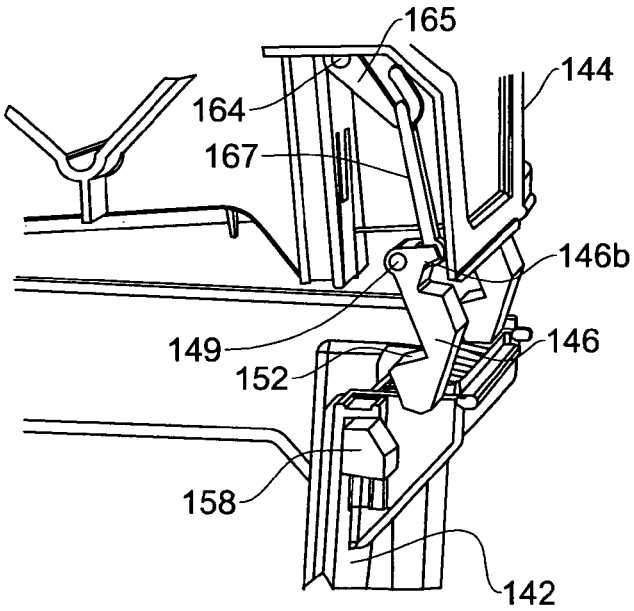
Figure 11A:
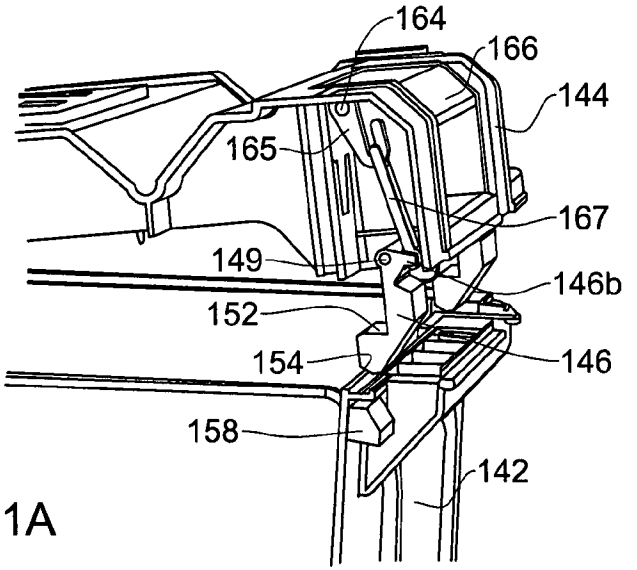
FIGS. 11A through 11D are cross-sectional views, taken along line VII-VII in FIG. 8B, of the toolbox during closing (i.e., "drop-locking") thereof.
Figure 11B:
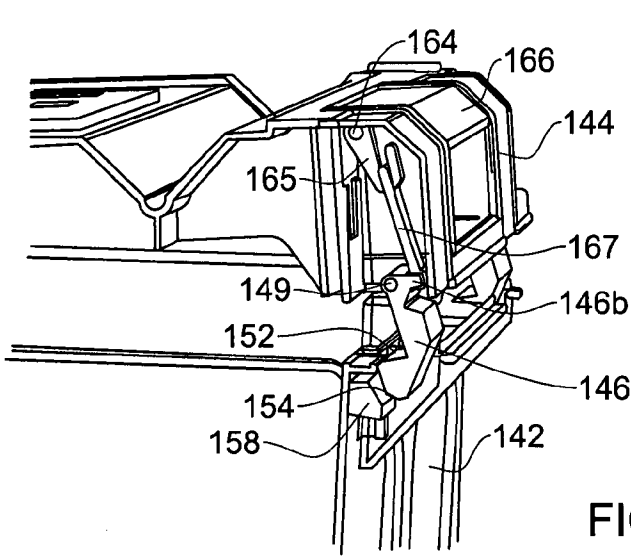
Figure 11C:
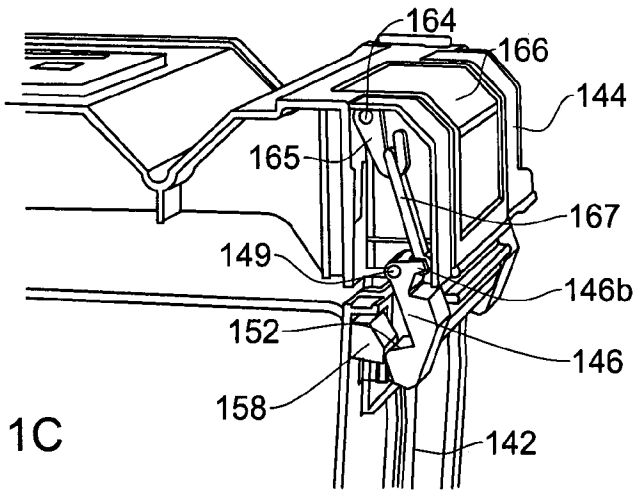
Figure 11D:
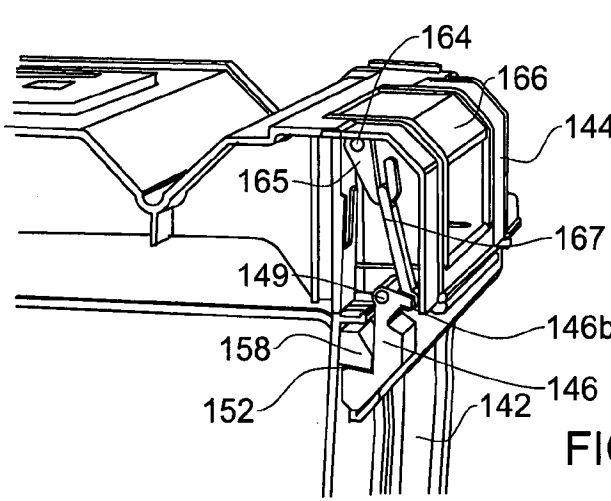

In use, the activation mechanism 162 is used to move each latch 146 from its locked position when the lid 144 is in its closed position to the unlocked position, as illustrated in FIGS. 10A through 10C. Initially, as illustrated in FIG. 10A, the lid 144 is in its closed position with the latch 146 in its locked position. As illustrated in FIG. 10B, the lever 166 is pivoted upwardly, which rotates the lifting member 165 in the direction indicated by arrow 171, i.e., toward the front of the toolbox 140. This raises the connecting member 167, which in turn raises the upper end 146*b* of the latch 146. The latch 146 thus pivots about the pin 149 into its unlocked position. In this position, the lower end 146*a* of the latch 146 is located such that the upwardly facing lip 152 thereof can clear the protrusion 158 when the lid is raised, as seen in FIG. 10C. Thus, a single upward motion, which may be performed with one hand, is sufficient to unlock and open the lid 144.

The lid 144 may be dropped into its closed position, causing the latches 146 to be brought into their locked position, as illustrated in FIGS. 8A through 8D. When the lid 144 is dropped from its open position, as illustrated in FIG. 8A, the lower surface 154 of each of the latches 146, which, due to the biasing members, are in their locked positions, strike the protrusion 158, as illustrated in FIG. 8B. Due to the angle of the lower surfaces 154, the latches 146 are pivoted temporarily into their respective unlocked positions, thereby allowing the lid 144 to fully close and for the lower end 146*a* of the latch to fully clear the protrusion 158, as illustrated in FIG. 8C. Once this occurs, the biasing members return the latches 146 to their locked positions, as illustrated in FIG. 8D. Thus, the toolbox 140 may be "drop-locked", i.e., the lid 144 may be closed, and the latches 146 automatically lock the toolbox.

Figure 9B:
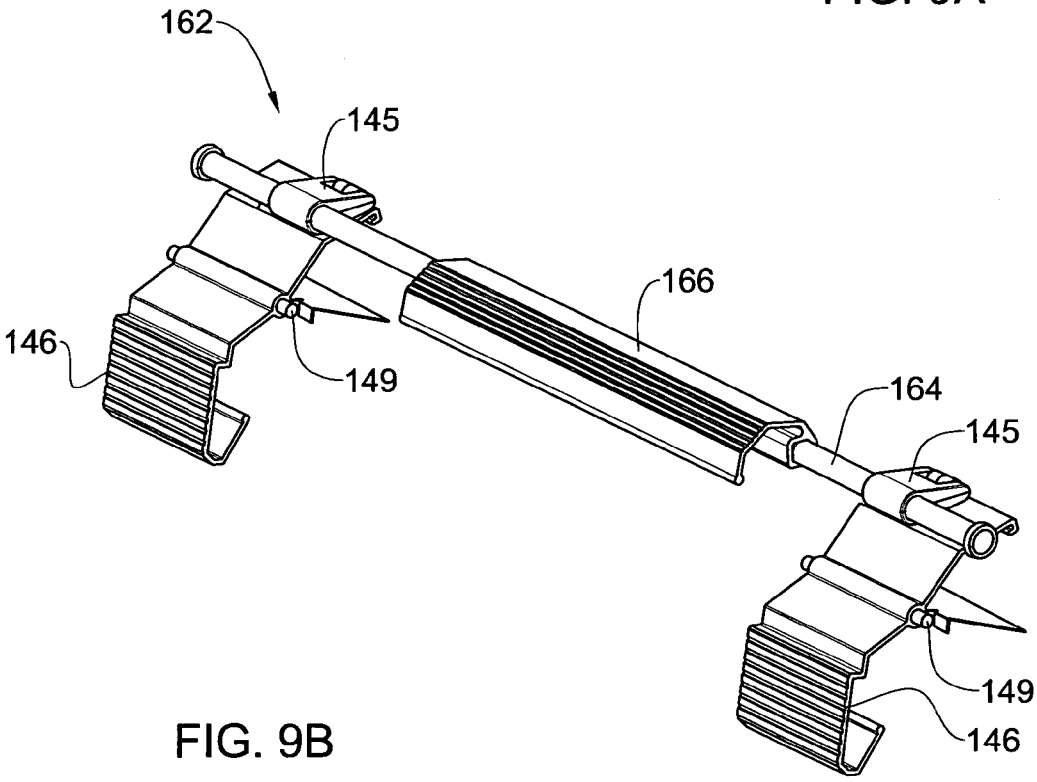
FIG. 9B is a perspective view of another embodiment of an activation mechanism and latches of the toolbox illustrated in FIGS. 8A and 8B.

FIG. 9B illustrates another embodiment which may be substituted for that illustrated in FIG. 9A. The construction and operation of the actuation mechanism 162 illustrated and latches 146 illustrated in FIG. 9B is similar to that illustrated in FIG. 9A, with the differences delineated below.

In the example illustrated in FIG. 9B, two cams 145 are mounted on the transmission rod 164. Each cam 164 is disposed so as to bear upon an upper end of one of the latches 146, which pivots it about pin 149. The biasing members 150 are in the form of a bent member made of rigid yet flexible material (such as a bent sheet of thin steel constituting a flat spring).

Figure 12A:
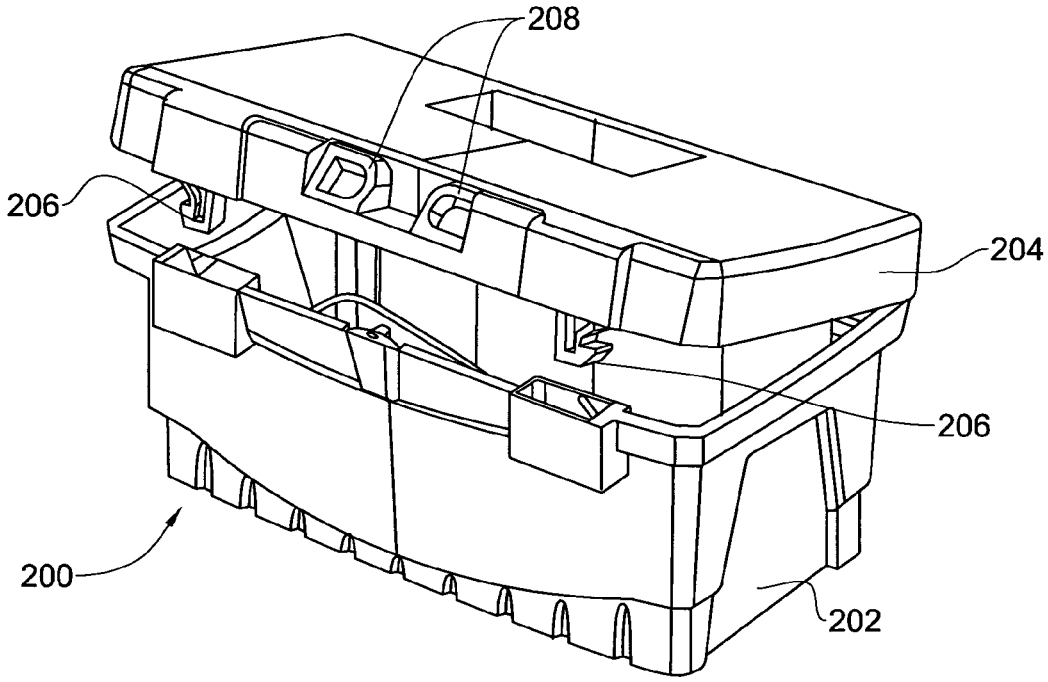
FIGS. 12A and 12B are perspective views of a toolbox according to a further embodiment with the lid in an open and closed position, respectively.
Figure 12B:
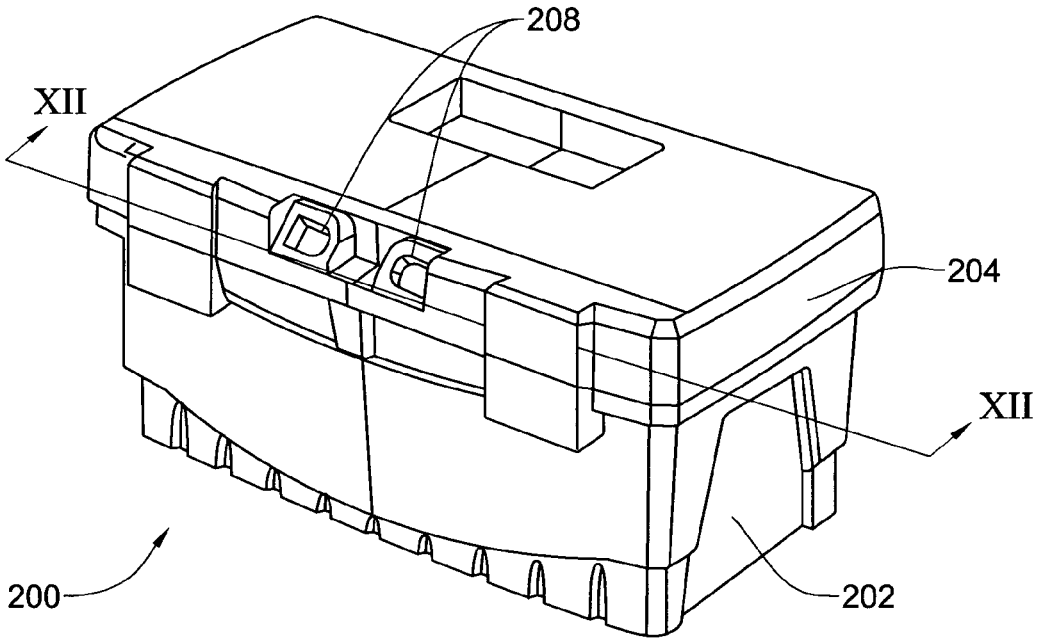

According to another embodiment, as illustrated in FIGS. 12A through 12D, there is provided a toolbox, generally indicated at 200, which comprises a basin portion 202 and a lid 204 pivotally articulated thereto between an open position, for example as seen in FIG. 12A, and a closed position, for example as seen in FIG. 12B.

As better seen in FIG. 12A, the lid 204 comprises two latches 206 and two grips 208, each of which is associated with one of the latches. The grips 208 constitute part of an activation mechanism, the rest of which is not visible in FIG. 12A.

Figure 12C:
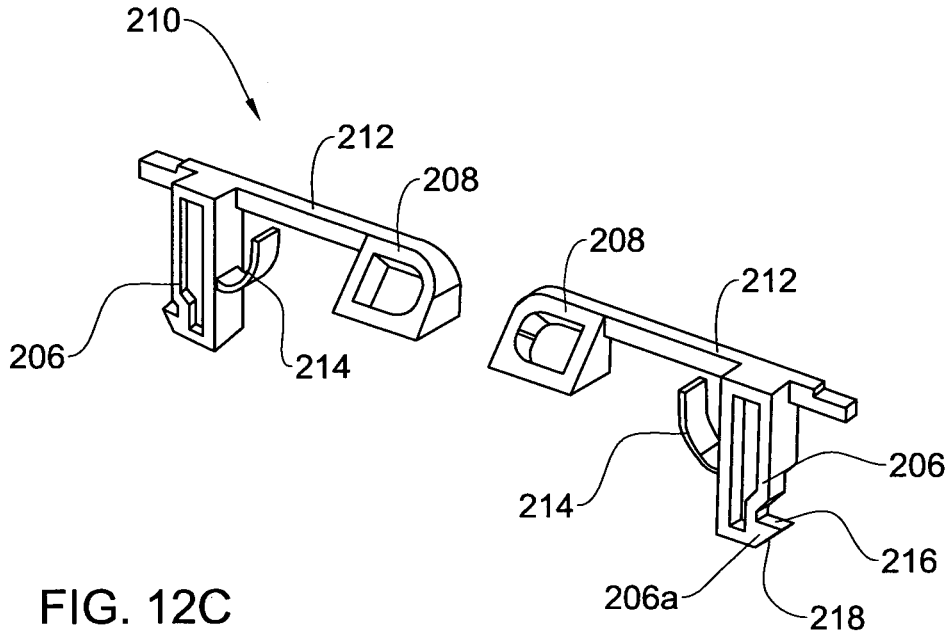
FIG. 12C illustrates activation mechanisms and latches of the toolbox illustrated in FIGS. 12A and 12B.

FIG. 12C better illustrates the activation mechanism 210 and the latches 206.

Each latch 206 is adapted to slide between a locked position (as illustrated, e.g., in FIG. 12A) and an unlocked position (not illustrated). Biasing members 214 are integrally formed on each latch 206, each adapted to bias or urge its associated latch into its locked position. Each latch 206 comprises a lower end 206*a* having an upwardly facing lip 216 and an angled lower surface 218, and an upper end 206*b*.

The activation mechanism 210 comprises the grips 208 and a transmission member 212 between each latch 206 and its associated grip. The transmission member 212 is slideably accommodated within the lid 204 of the toolbox 200.

Figure 12D:
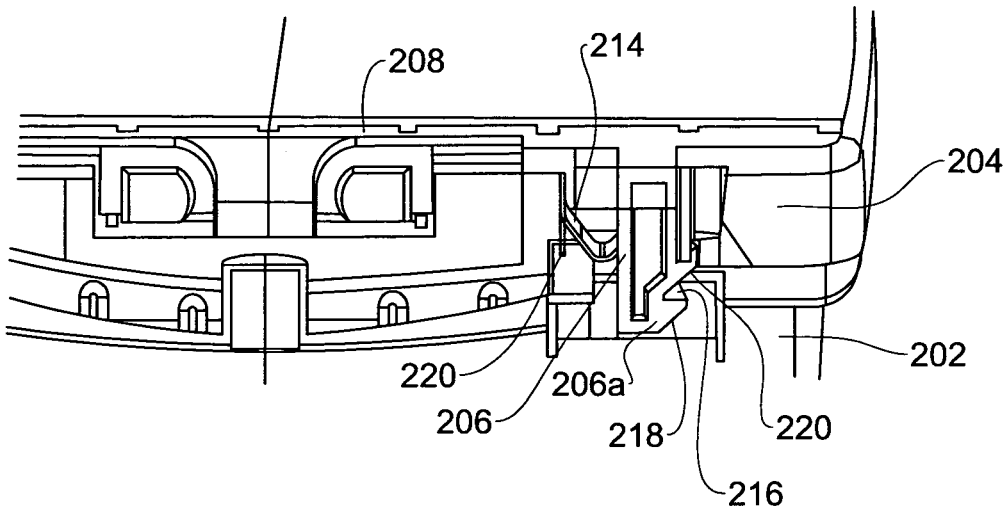
FIG. 12D is a partial cross-sectional view taken along line XII-XII in FIG. 12B.

As illustrated in FIG. 12D, the basin portion 202 of the toolbox 200 comprises two protrusions 220, constituting latch-receiving arrangements. Each of the protrusions 220 may be formed integrally with a sidewall of the basin portion 202 of the toolbox 200, or as a separate piece attached thereto. Each protrusion 220 is adapted to prevent one of the latches 206 from being raised when the lid 204 is in its closed position and the latch is in its locked position, thus preventing opening of the lid without pivoting the latches to their unlocked positions. This is accomplished by the co-disposition of the each protrusion 220 and its respective latch 206, when in its locked position with the lid 204 in its closed position, such that the upwardly facing lip 216 bears against the bottom of the protrusion 220 when an attempt to open the lid is made.

In addition, the basin portion 202 of the toolbox 200 comprises two fixed walls 222, each disposed opposite one of the protrusions 220. Each fixed wall is position such that when the lid 204 is in its closed position, the biasing member 214 bears against it, thus urging the latch 206 into its locked position.

In use, the lid 204 is initially in its closed position with the latches 206 in their locked positions. The grips 208 are slid toward each other by a user when the lid 204 is in its closed position, thus sliding each latch 206 from its locked position to the unlocked position. In this position, the lower end 206*a* of the latch 206 is located such that the upwardly facing lip 216 thereof can clear the protrusion 220 when the lid is raised.

The lid 204 may be dropped into its closed position, causing the latches 206 to be brought into their locked position. When the lid 204 is dropped from its open position, the latches 206 may be in their locked or unlocked position. If they are in their unlocked position, the biasing member 214 bears against one of the fixed walls 222, thus urging it toward its locked position. In the locked position of the latch 206, the lower surface 218 of each of the latches strikes the protrusion 220. Due to the angle of the lower surfaces 218, the latches 206 are slid temporarily into their respective unlocked positions, thereby allowing the lid 204 to fully close and for the lower end 206*a* of the latch to fully clear the protrusion 220. Once this occurs, the biasing members 214 return the latches 206 to their locked positions. Thus, the toolbox 200 may be "drop-locked", i.e., the lid 204 may be closed, and the latches 206 automatically lock the toolbox.

Figure 13A:
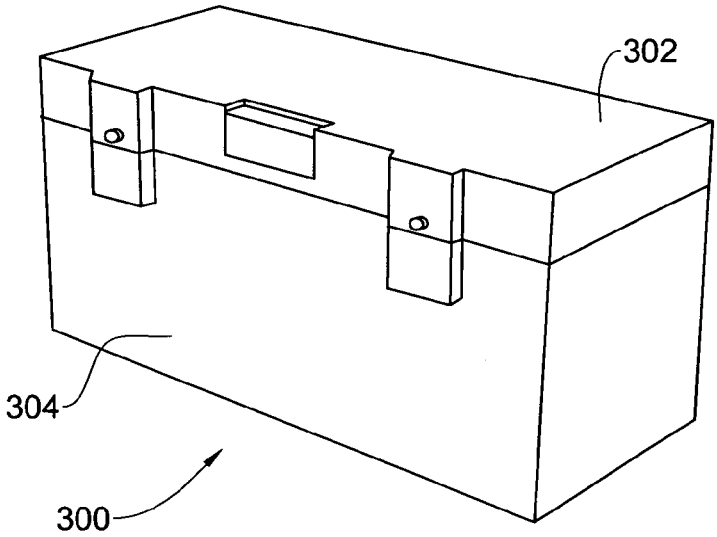
FIG. 13A is a perspective view of a toolbox according to a still further embodiment with the lid in a closed position.

According to another embodiment, as illustrated in FIGS. 13A through 13D, there is provided a toolbox, generally indicated at 300, which comprises a basin portion 302 and a lid 304 pivotally articulated thereto between an open position (not illustrated) and a closed position, for example as seen in FIG. 13A.

Figure 13D:
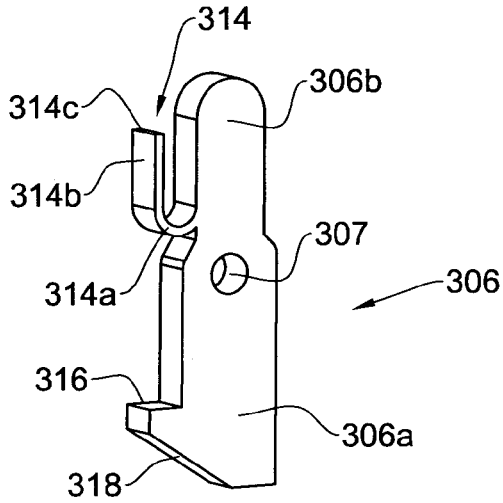
FIG. 13D is a perspective views of an example of a latch of the toolbox illustrated in FIG. 13A.
Figure 13C:
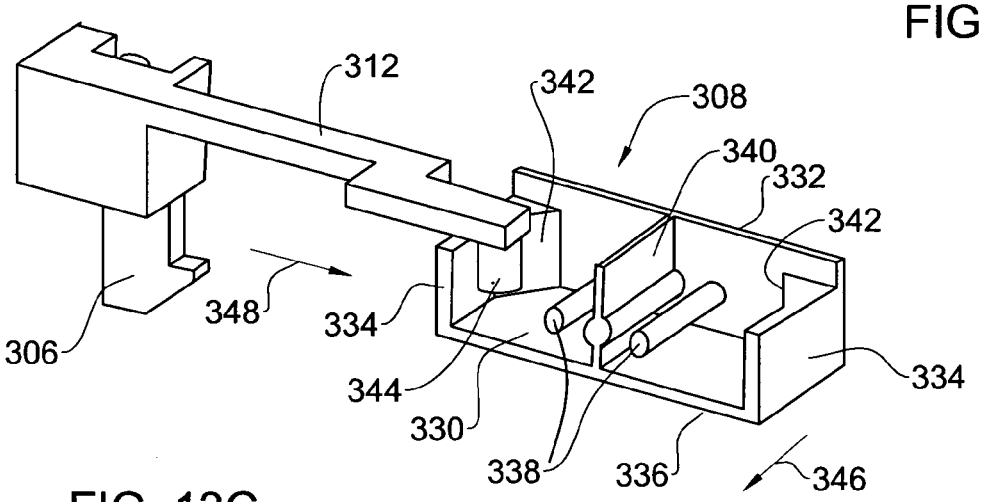
FIG. 13C illustrates an activation mechanism and latch of the toolbox illustrated in FIG. 13A.
Figure 13B:
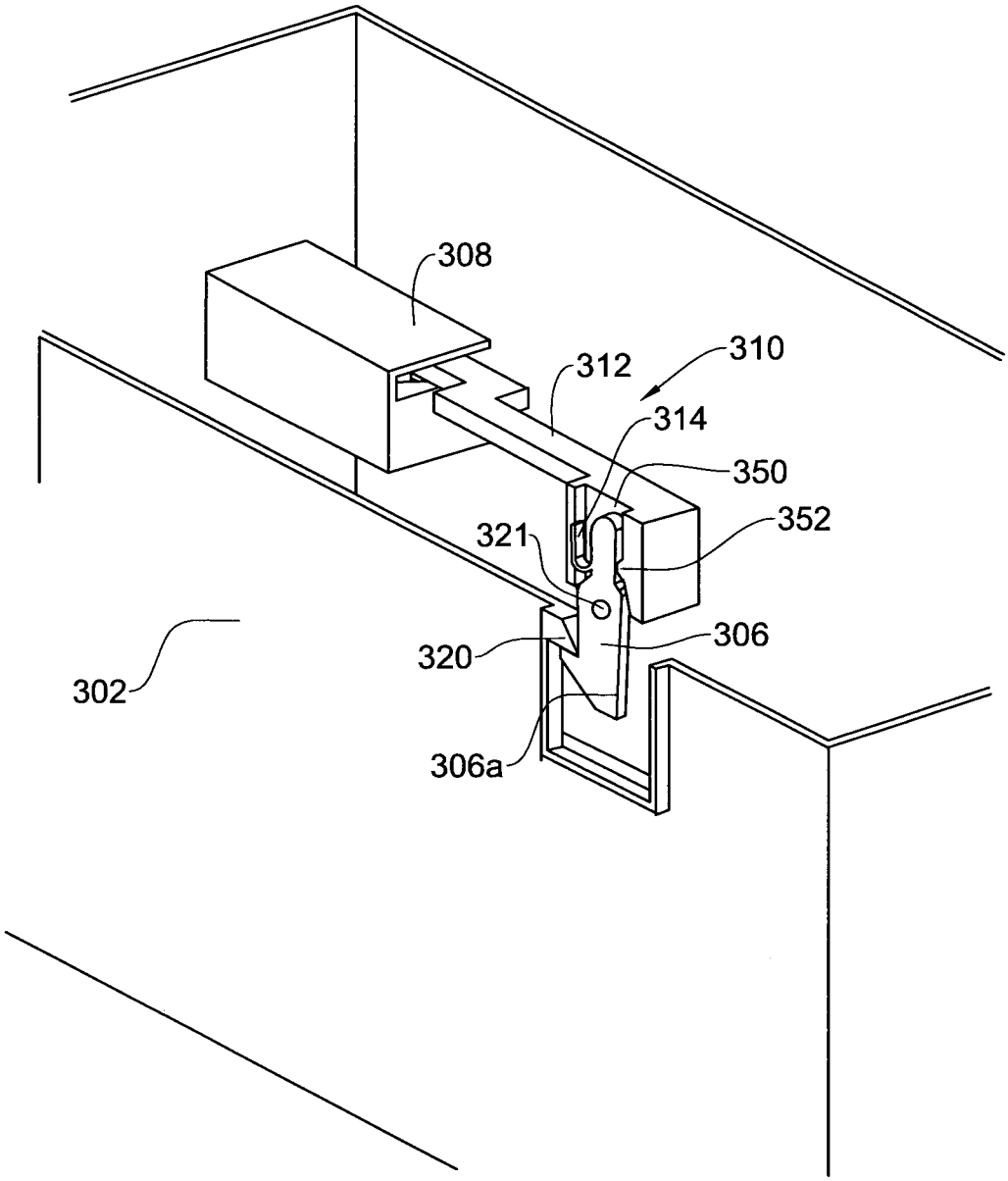
FIG. 13B is a perspective view of the toolbox illustrated in FIG. 13A with a lid thereof removed.

As seen in FIGS. 13B and 13C, the lid 304 (not illustrated in FIG. 13B) houses two latches 306 (only one of which is illustrated) and an activation mechanism 310 comprising and a push-member 308 and two transmission members 312 (only one of which is illustrated) slidingly accommodated within the lid, each of which operationally connects the push-member to one of the latches.

As best seen in FIG. 13C, the push-member 308 (which is shown in partial sectional view with a top portion thereof removed) has a hollow interior 330 between a front wall 332, sidewalls 334, a bottom wall 336, and a top wall (not illustrated in FIG. 13C). Peg-like protrusions 338 protruding from the front wall 332 are provided, as well as a support wall 340, adapted to strengthen the push-member 308. Interior surfaces of the sidewalls 334 are formed with inclined portions 342. The transmission member 312 is fitted with a roller 344 which is freely rotatable about a pin (not illustrated) projecting downwardly from en end thereof. Each inclined portion 342 and roller 344 are arranged/co-disposed such that upon actuation of the push-member 308 inwardly, i.e., in the direction indicated by arrow 346 (i.e., pushing upon the front wall 332 by a user), the inclined portion bears upon its associated roller, thus actuating the transmission member 312 in a direction indicated by arrow 348. In addition, the push-member 308 may be provided with biasing members (not illustrated), for example springs fitted over the peg-like protrusions 338, which urge the push-member forward (i.e., in a direction opposite that of arrow 346) after pushing upon the front wall 332 by a user.

The inclined portions 342 and rollers 344 may be substituted by any suitable combination of cooperating elements which are adapted to actuate the transmission member 312 in response to inward actuation of the push-member 308 as described above. For example, inclined portions, each oppositely formed to its respective inclined portion 342 formed on the interior surfaces of the sidewall 334, may be formed on the transmission members 312, without departing from the scope of the invention.

Each latch 306 is adapted to pivot between a locked position (as illustrated, e.g., in FIG. 13B) and an unlocked position (not illustrated). As illustrated in FIG. 13D, each latch 306 comprises a lower end 306*a* having an upwardly facing lip 316 and an angled lower surface 318, and an upper end 306*b*. A through-going aperture 307 is formed in the latch 306 between the lower and upper ends 306*a*, 306*b*. In addition, the transmission member 312 comprises a latch-receiving portion 350 adapted to receive the upper end 306*b* of the latch 306. A bulge 352 may be formed on an interior portion of the latch-receiving portion 350.

Figure 13E:
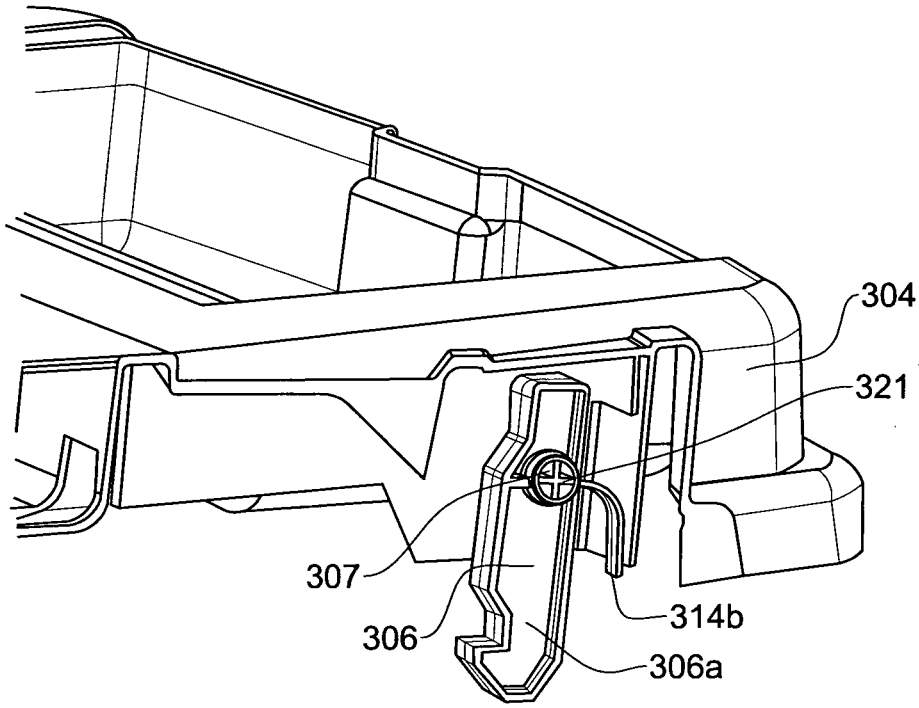
FIGS. 13E and 13F are partial sectional views of further examples of latches of the toolbox illustrated in FIG. 13A.

A biasing member, generally indicated at 314, is integrally formed on each latch 306, adapted to bias or urge its associated latch into its locked position. The biasing member may be J- or U-shaped, having a lower curved portion 314*a* attached at one end to the upper end 306*b* of the latch 306 (or attached such that a free end 314*c* of the upright portion 314*b* is opposite the upper end of the latch), and at another end to an upright portion 314*b* which is generally parallel to the latch. As illustrated in FIG. 13E, the biasing member may be attached to the middle of the latch 306, such that the free end of the upright portion 314*b* is opposite the lower end 306*a* of the latch (i.e., it is below the aperture 307 about which the latch pivots). According to either configuration, the biasing upright portion 314*b* of the biasing member 314 is opposite the side of the latch 306 which constitutes a leading edge when pivoting from its locked position to its unlocked position. A pin 321, being formed integrally with or otherwise connected to the lid 304, is provided received within the aperture 307 of the latch 306, to allow pivoting motion of the latch thereabout.

Figure 13F:
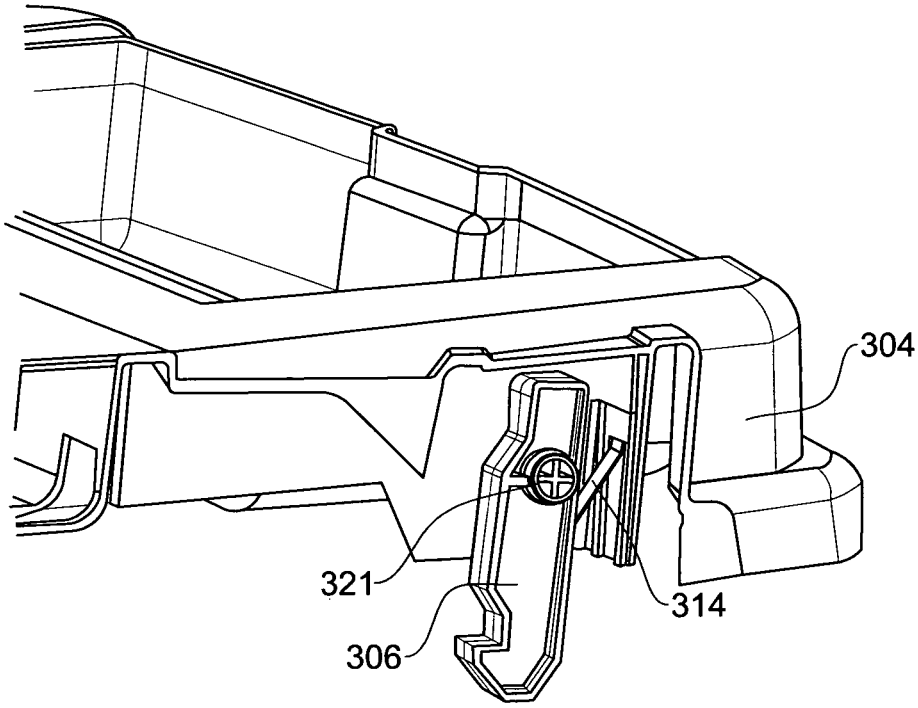

According to another example, as illustrated in FIG. 13F, the biasing member 314 may be formed as part of the lid 304, either formed integrally therewith, or formed as a separate member attached thereto. It will be noted that in the examples illustrated in FIGS. 13E and 13F, the biasing member acts directly between the lid 304 and the latch 306.

As illustrated in FIG. 13B, the basin portion 302 of the toolbox 300 comprises two protrusions 320 (only one of which is illustrated), constituting latch-receiving arrangements. Each of the protrusions 320 may be formed integrally with a sidewall of the basin portion 302 of the toolbox 300, or as a separate piece attached thereto. Each protrusion 320 is adapted to prevent its associated latch 306 from being raised when the lid 304 is in its closed position and the latch is in its locked position, thus preventing opening of the lid without pivoting the latches to their unlocked positions. This is accomplished by the co-disposition of the each protrusion 320 and its respective latch 306, when in its locked position with the lid 304 in its closed position, such that the upwardly facing lip 316 bears against the bottom of the protrusion 320 when an attempt to open the lid is made.

In use, the lid 304 is initially in its closed position with the latches 306 in their locked positions. The push-member 308 is pushed inwardly as described above with reference to FIG. 13C, thus actuating the transmission member 312 as described above. The bulge 352 of the latch-receiving portion 350 of the transmission member 312 bears against the latch 306, thus pivoting it about the pin 321 into its unlocked position. In this position, the lower end 306*a* of the latch 306 is located such that the upwardly facing lip 316 thereof can clear the protrusion 320 when the lid 304 is raised. Upon release of the push-member 308 by the user, the biasing member thereof (not illustrated) returns the push-member to its original (i.e., un-pushed) position. In addition, the biasing member 314 bears against the inner surface of the latch-receiving portion 350, thus causing the transmission bar 312 to return to its original position, and the latch 306 to return to its locked position.

The lid 304 may be dropped into its closed position, with the latches 306 in their locked positions. When the lid 304 is dropped from its open position, the lower surface 318 of each of the latches strikes its associated protrusion 320. Due to the angle of the lower surfaces 318, the latches 306 are pivoted temporarily into their respective unlocked positions, thereby allowing the lid 304 to fully close and for the lower end 306*a* of the latch to fully clear the protrusion 320. Once this occurs, the biasing members 314 return the latches 306 to their locked positions. Thus, the toolbox 300 may be "drop-locked", i.e., the lid 304 may be closed, and the latches 306 automatically lock the toolbox.

Figure 14:
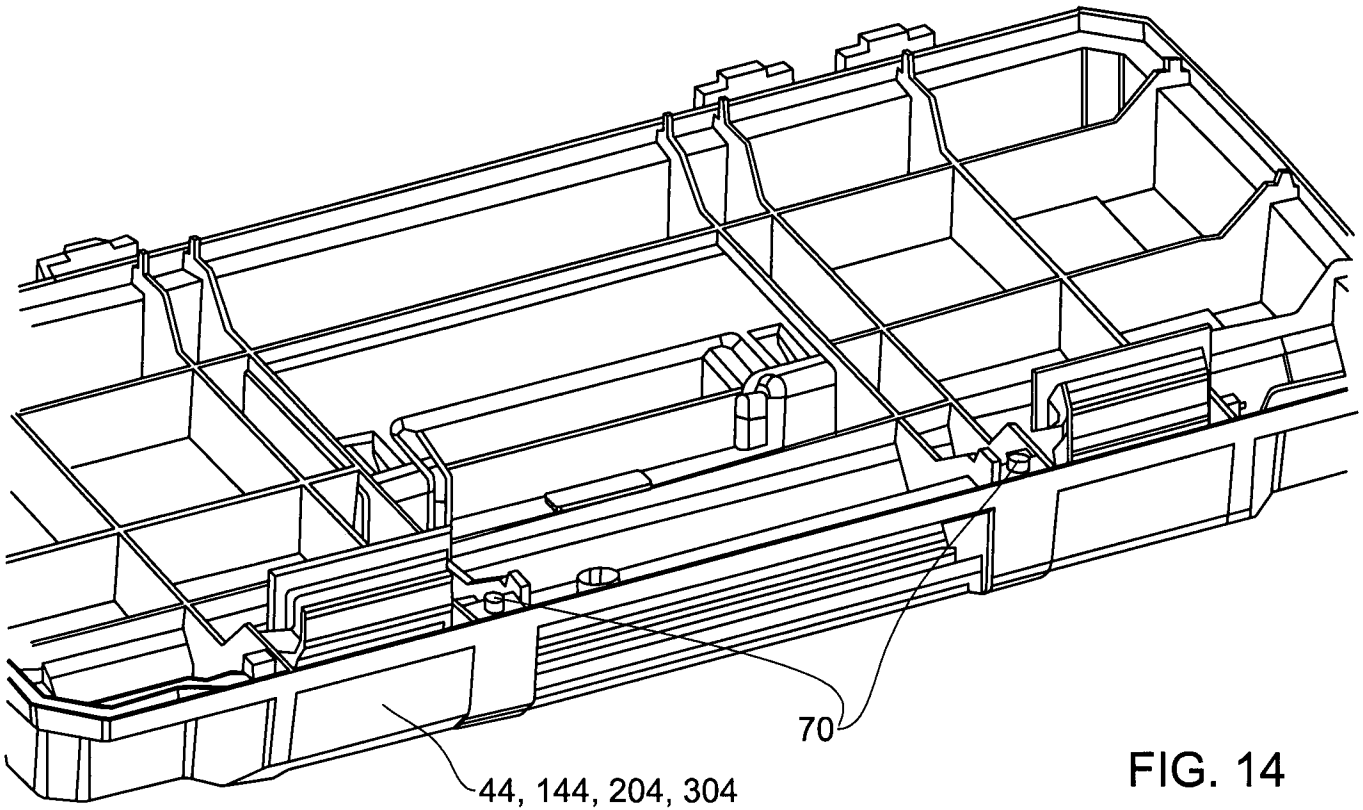
FIG. 14 is an underside perspective view of the lid of the toolbox according to either of the embodiments illustrated in FIGS. 4 through 11D, according to a modification.

As illustrated in FIG. 14, the lid 44, 144, 204, 304 according to any one of the above examples may be provided on its underside with one or more cushioning members 70, such as elastomeric pads, which serve to cushion the lid when "drop-locked". This reduces noise upon "drop-locking", and helps prevent long-term damage to the lid which may result therefrom. As illustrated FIG. 12, the cushioning members are advantageously provided on the same edge of the lid 44, 144, 204, 304 as the latches.

Those skilled in the art to which this invention pertains will readily appreciate that numerous changes, variations and modifications can be made without departing from the scope of the invention mutatis mutandis.

The invention claimed is:

1. A toolbox, comprising:

a basin portion; and a lid pivotally articulated thereto between an open position and a closed position, the lid comprising two or more latches, each positionable between a locked position and an unlocked position, two or more biasing members, each associated with one of the latches and configured to bias its associated latch toward its locked position, and an activation mechanism comprising transmission members, each transmission member being slideably received within the lid so that it can slide along an axis extending substantially between two of the latches and each associated with a latch so that actuation thereof along the axis brings its associated latch into its unlocked position, and the activation mechanism comprising a push-member formed so that upon actuation thereof in a direction substantially perpendicular to the axis, the transmission members are actuated along the axis, the push-member and transmission members being formed with inclined portions, each of the transmission members being formed with a freely rotating roller, the inclined portions and rollers being co-disposed such that the actuation of the push-member effects the actuation of the transmission members along the axis, the activation mechanism being operationally connected to the latches such that operation of the activation mechanism brings all of the latches to their unlocked positions, and the basin comprising two or more latch-receiving arrangements, each configured to receive a first end of one of the latches when in the locked position with the lid in its closed position, thereby preventing articulation of the lid to its open position, the latches and latch-receiving arrangements being mutually configured such that upon articulation of the lid toward its closed position, the latch-receiving arrangements are configured to urge the latches from their locked positions so as to allow the lid to be brought fully to its closed position.

2. The toolbox according to claim 1, formed so that upon full articulation of the lid into its closed position, each biasing member spontaneously returns its associated latch to its locked position.

3. The toolbox according to claim 1, wherein each of the biasing members is constituted by a sheet spring.

4. The toolbox according to claim 1, wherein each of the biasing members is formed integrally with its associated latch.

5. The toolbox according to claim 1, wherein the biasing members constitute parts of the lid, each being disposed adjacent to its associated latch.

6. The toolbox according to claim 5, wherein the biasing members are formed integrally with the lid.

7. The toolbox according to claim 1, each of the latch-receiving arrangements comprising a latch-receiving notch and a barrier therein, and each of the latches comprising a lip at a first end thereof, the lip configured to bear against the barrier when the lid is in its closed position and the latch is in its locked position.

8. The toolbox according to claim 1, the activation mechanism being operationally connected to the latches by a rod, wherein upon operation of the activation mechanism, the rod bears upon a second end, being opposite the first end, of each latch, thereby pivoting each latch into its unlocked position.

9. The toolbox according to claim 8, wherein the activation mechanism comprises a lever pivotally articulated to the lid, the lever being rigidly attached to a guide member extending therefrom, the guide member being positioned so as to bear upon the rod when the activation member is operated.

10. The toolbox according to claim 8, the activation mechanism being operationally connected to each of the latches by a connecting member associated therewith.

11. The toolbox according to claim 10, each of the latch-receiving arrangements comprising a protrusion, and each of the latches comprising a lip at a first end thereof, the lip configured to bear against the protrusion when the lid is in its closed position and the latch is in its locked position.

12. The toolbox according to claim 11, wherein upon operation of the activation mechanism, the connection member pulls a second end, being opposite the first end, of each latch, thereby pivoting each latch into its unlocked position.

13. The toolbox according to claim 12, wherein each of the connection members is pivotally articulated to the second end of one of the latches.

14. The toolbox according to claim 1, wherein a bottom surface of each of the latches is angled with respect to the direction of movement of the lid.

15. The toolbox according to claim 1, further comprising a push-member biasing member configured to return the push-member to its initial state after the actuation thereof.

16. The toolbox according to claim 1, further comprising one or more cushioning members, positioned so as to provide cushioning between the lid and the basin portion when the lid is brought from its open position to its closed position.

* * * * *